United States Patent [19]

Urquhart

[11] 3,997,424

[45] Dec. 14, 1976

[54] HYDROGENATIVE TREATMENT OF COAL

[75] Inventor: Donald Bremner Urquhart, London, England

[73] Assignee: Coal Industry (Patents) Limited, London, England

[22] Filed: Nov. 12, 1974

[21] Appl. No.: 523,066

[30] Foreign Application Priority Data

Nov. 27, 1973 United Kingdom ..... 55020/73

[52] U.S. Cl. ..... 208/8

[51] Int. Cl.[2] ..... C10G 1/04

[58] Field of Search ..... 208/8, 10

[56] References Cited

UNITED STATES PATENTS

| | | | |
|---|---|---|---|
| 1,949,891 | 3/1934 | Waterman | 208/8 |
| 3,558,468 | 1/1971 | Wise | 208/8 |
| 3,607,716 | 9/1971 | Roach | 208/8 |
| 3,607,717 | 9/1971 | Roach | 208/8 |
| 3,660,269 | 5/1972 | McCauley | 208/8 |
| 3,745,108 | 7/1973 | Schuman et al. | 208/8 |
| 3,808,119 | 4/1974 | Bull et al. | 208/8 |
| 3,819,506 | 6/1974 | Seitzer et al. | 208/8 |
| 3,850,738 | 11/1974 | Stewart et al. | 208/8 |

FOREIGN PATENTS OR APPLICATIONS

| | | | |
|---|---|---|---|
| 1,261,707 | 1/1972 | United Kingdom | 208/8 |

*Primary Examiner*—Delbert E. Gantz
*Assistant Examiner*—James W. Hellwege
*Attorney, Agent, or Firm*—Stevens, Davis, Miller & Mosher

[57] ABSTRACT

The invention relates to the hydrogenative treatment of coals by contacting the coal with carbon monoxide, water and a gaseous organic solvent at a reaction temperature within the range 300°–500° C. The solvent comprises one or more solvent components each of which, at the reaction temperature, is above its critical temperature so that the reaction products are extracted in the gaseous phase and are thereafter recovered from said phase after separation from the solid residue within the reaction chamber.

7 Claims, No Drawings

HYDROGENATIVE TREATMENT OF COAL

The present invention relates to the hydrogenative treatment of coal.

The treatment of coal with carbon monoxide and water has been known for over 50 years. The yields of ether-soluble material recovered are generally higher than those obtained with hydrogen at the same temperatures but with the development of the Fisher-Tropsch reaction, the carbon monoxide plus water approach to coal hydrogenation has not been pursued as rigorously as it might. It is generally believed that the hydrogenation of coal using carbon monoxide and water is effected by hydrogenation using nascent hydrogen which is believed to be formed by a water gas shift type reaction.

Recently, the hydrogenation of coal with carbon monoxide and water has been reinvestigated with the object or preparing oil which could then be converted to more volatile fuels by known hydrocracking techniques. Bituminous coal and lignite have been hydrogenated with carbon monoxide and water and the resulting products extracted with benzene. It has also been proposed to use phenanthrene as a solvent.

In another recent attempt at the hydrogenation of coal and coal residues, it has been proposed to hydrogenate coal with hydrogen gas in the presence of solvent and a catalyst. At the temperature generally employed for such hydrogenation, i.e., above 300° C, the coal substance breaks down and the molecular chains in the coal are cleaved to form substances of lower molecular weight. The lower molecular weight substances or products have a molecular size that they are generally suitable for use as fuel oil or the like. It has been proposed to subject these products to hydrocracking for the conversion into synthetic gasoline. The hydrogenation reactions themselves are somewhat complicated as the mechanisms are not known with any degree of certainty, but it is believed that the reactions involved may include both the thermal decomposition of the coal substance in the coal and hydrogenatic degradation of the coal substance. In each case a pitch or tar-like mixture is formed which is liquid at the temperatures involved and contains compounds having 20 or more carbon atoms. The mixture, under the reaction conditions during the hydrogenative extraction, then undergoes further thermal and hydrogenative degradation.

Catalysts have been used to improve the efficiency of the degradation and in consequence it has become unnecessary to ensure efficient contact between the coal, hydrogen and the catalyst.

The present applicants have found that if coal and coal products are contacted with an organic solvent above the critical temperature and pressure of the solvent and current treatment with carbon monoxide and water, the yield of hydrogenative products and/or the rate of reaction are generally improved relative to the uncatalysed hydrogenation reaction under the same reaction condition.

According to the present invention, therefore, there is provided a process for the hydrogenative treatment of coals which process comprises contacting the coal with carbon monoxide, water and a gaseous organic solvent at a reaction temperature of within the range 300° to 550° C wherein the solvent comprises one or more solvent components each of which, at the reaction temperature, is above its critical temperature and extracting the reaction products in the gaseous phase and thereafter recovering the reaction products from said gaseous phase.

The carbon monoxide concentrations may be greater than 20 atmospheres gauge and preferably greater than 50 atmospheres gauge. It has been found that a pressure within the range of 50 to 250 atmospheres is satisfactory. The proportion of carbon monoxide per kilogram of coal is preferably within the range of 200 to 800 grams.

The water concentrations are not particularly critical but it is preferred that below the critical temperature the water is preferably present as a saturated vapour. Ideally, the proportion should be greater than 1 mole of water per mole of carbon monoxide and preferably at least 3 moles of water per mole of carbon dioxide.

For the purposes of the present specification, coals are to be understood to include materials formed by the degradation of cellulosic material of plant origin, and include tar residues and tar distillate residues and like carbonaceous materials. The degradation of cellulosic material to form coals has been carried out at varying conditions of heat and pressure. Coals are believed, in general, to comprise cross-linked carbon structures of varying degrees of aromaticity which structures include various elements other than carbon and hydrogen, in particular oxygen, nitrogen and sulphur. In the formation of coal, oxygen and hydrogen are generaly lost from the coal as the degree of cross-linking increases. The properties of coal vary in accordance with its age and history, and the term "coal" as used in this specification includes lignites which are sometimes known as "brown coal" and which are relatively younger than the bituminous or "black coal. "

The coal is preferably employed in a finely divided form. Relatively large lumps of coal may in principle be employed but it may be difficult or slow for the extractable constituent of the coal to be removed from the center of the larger lumps. In a continuous process, furthermore, it is undesirable to employ large lumps of coal as this gives rise to a mechanical handling problem in the passage of the coal through the pressurizing pumps necessary to raise the pressure of the coal and solvent to a sufficiently high level during the reaction.

Thus it is preferred that the coal particles should pass a 5.0 mm mesh screen and more preferably a 3.0 mm mesh screen. In particular it is preferred that at least 90% and more preferably 95% of the coal particles should pass a 1.5 mm mesh screen.

The coal and the solvent are advantageously mixed at atmospheric pressure. This is chiefly because of mechanical handling problems if superatmospheric pressure is employed; such superatmospheric pressure may however be used if desired. The coal and solvent may be mixed at temperatues that are not very substantially above ambient temperatures. However, as it is normal practice to recycle the solvent, it will not normally be economic to cool the solvent more than is necessary. Thus, depending on the boiling point of the solvent, temperatures of the solvent of up to about 150° C. or above may be employed.

By "gas phase solvent" it is to be understood a solvent which at the extraction temperature is above the critical temperature. The solvent may contain "utilizable solvent components" as hereinafter defined which are the effective solvent agents. These "utilizable solvent components" may comprise the whole of the solvent medium or may be present together with components which do not themselves have a solvent action.

By "utilizable solvent component" is meant a solvent component selected from water, hydrocarbons and organic derivatives of hydrocarbons preferably containing carbon, and hydrogen only, with no other elements, which solvent components have a critical temperature of above about 150° C, and preferably have a critical temperature of below about 450° C. Desirably the critical temperature or such utilizable solvent components is above about 250° C, and it will often be found that the most suitable utilizable solvent components have a critical temperature of less than about 400° C. The utilizable solvent components should desirably be stable at the extraction temperature; that is they should not substantially decompose at or below the extraction temperature; the utilizable solvent components should desirably not react with the coal or the hydrogen or the catalyst or other of the utilizable solvent components under the conditions to which they are subjected. However, it will be understood that some at least of the components of a solvent mixture may at least partially react or decompose. It is the mixture of the utilizable solvent mixture that is in contact with the coal at the extraction temperature, allowing for any such decomposition or reaction, that is to be considered for the purposes of the present invention. In some instances some components of the solvent may not be in the gas phase but may still exhibit a solvent action. It will be understood that any part of the components of the solvent mixture that so reacts or decomposes will not be available to be recycled as itself, but the reacted or decomposed products may, as appropriate, be recycled. In particular, certain aromatic compounds, particularly polycyclic aromatic compounds, may be hydrogenated under the conditions encountered. These hydrogenated compounds may act as hydrogen donors, reaction with the coal substance and degradation products thereof to donate hydrogen thereto, and may thereby produce an improved yield of hydrogenated product extracted from the coal, thereby acting at least partially catalytically.

The reduced partial pressure of any such utilizable solvent component, $i$, is its partial pressure $P_i$ at the extraction temperature relevant to its critical pressure $PC_i$, that is $P_i/P_{Ci}$. The requirement that the sum of the reduced partial pressures of those utilizable solvent components that are above their critical temperature at the extraction temperature be greater than one is equivalent, for a single substance solvent, to specifying that the single substance solvent is above its critical pressure. A single component solvent may be employed but, in processes carried out on a commercial scale, it is generally more practical and economic to employ a mixture of compounds as solvents. It is to be noted that the solvent medium, if a mixture, is not necessarily wholly either above its critical temperature or even in the vapor phase at the extraction temperature. If the solvent medium contains a significant proportion of a substance whose critical temperature is above the extraction temperature, a portion at least of this substance may dissolve in the supercritical portion of the solvent. A portion of the substance whose critical temperature is above the extraction temperature may remain as a liquid phase; this is not detrimental to the carrying out of the invention in principle, but there may be difficulty in recovering such a portion of the solvent medium. The reaction products, if the extraction temperature is above their critical temperature, may themselves comprise a portion of the utilizable solvent components for the purposes of the invention.

It is, in general, desirable that the sum of the reduced partial pressures of those of the utilizable solvent components having their critical temperatures between 100° C below the extraction temperature and the extraction temperature is at least one. Preferably the sum of the reduced partial pressures of those of the utilizable solvent components having their critical temperatures between 50° C below the extraction temperature and the extraction temperature is at least one. It is believed, from considerations generally taught in the art, for example in Paul and Wise "The Principles of Gas Extraction" published by Mills & Boon Ltd. in London in 1971, that the solvation capacity of a supercritical gas increases as it approaches its critical temperature. Accordingly, it is in general preferred that the utilizable solvent components employed, or as large a proportion of the utilizable solvent components as possible, are close to, but above, their critical temperature.

The solvents employed may include aromatic hydrocarbons having a single benzene ring and preferably not more than four carbon atoms in substituent groups may be employed, for example benzene, toluene, xylene, ethylbenzene, isopropylbenzene and tetramethylbenzene. Cycloaliphatic hydrocarbons may be employed, preferably those having at least five carbon atoms, and having not more than twelve carbon atoms, for example, cyclopentane, cyclohexane and cis- and trans-decalin, as well as alkylated derivatives thereof. Aromatic hydrocarbons having two aromatic rings may be used although it will be noted that their critical temperatures are relatively high; for example, naphthalene has a critical temperature of 477° C, methylnaphthalene has a critical temperature of 499° C, bisphenyl has a critical temperature of 512° C and bisphenylmethane has a critical temperature of 497° C; thus the aromatic hydrocarbons having two aromatic rings specifically named all have critical temperatures towards the upper end of the reaction temperature range of the present invention. Acyclic aliphatic hydrocarbons preferably those having at least five carbon atoms and not more than 16 carbon atoms may be used. The hexanes, octanes, dodecanes and hexadecanes may be employed but it will be noted that the hexadecane has a critical temperature of 461° C. The aliphatic hydrocarbons are preferably saturated since the corresponding alkenes are liable to be at least partially reduced under the reaction conditions. In general, it is preferred that straight-chained aliphatic hydrocarbons are employed to prevent or reduce the tendency of molecular rearrangements and cross-alkylation reactions of both branch-chained aliphatic hydrocarbons and branch-chained alkylated aromatic compounds.

Phenols, preferably those derived from aromatic hydrocarbons having up to eight carbon atoms may be employed although the phenolic hydroxyl group is liable to be reduced under the extraction conditions, for example, phenol, anisole and xylenol. Other oxygen containing compounds are liable to reduction and their use in large quantities as solvent components is not desirable.

Other compounds which are not themselves reduced or liable to reduction under the reaction conditions may be subjected to molecular rearrangements, particularly under the influence of small amounts of impurities which have a catalytic effect. Typical examples of such solvents are alcohol, which can be reduced to corresponding hydrocarbons aldehydes and ketones. On the other hand, ethers, if sufficiently stable may be employed, for example, bisphenylether, having a critical temperature of 494° C would be a suitable compound.

The proportion of solvent or gaseous phase extractant employed in the invention is not critical but since the extraction of the products and their take-up by the solvent is dependent upon the concentration of products in the solvent, it is clear that the lower the concentration of products in the solvent, the better will be the rate of extraction of the products from the reaction system. In general, it is preferred that the solvent should operate at less than 80% of the solubility of the products therein, but on the other hand in view of the large amounts of solvent that would be required, concentrations of less than 30% of the solubility are impractical commercially, and concentrations of the order of 50 to 60% of the solubility have been found to provide adequate rates of reaction. For the same reason it is preferred that the process be a continuous process with the solvent and reaction gases being recirculated as far as possible. The parameters determining the solubility of the products in the gaseous phase solvent and the rates of reaction dependent thereon are well within the purview of the competent chemical engineer and do not, as such, form part of the present invention.

Following is a description by way of example only of carrying the invention into effect.

A Markham coal was crushed to a nominal ⅛ inch size and was air dried. The analysis of the coal was as follows:

| | |
|---|---|
| $H_2O$ | 8.0% |
| ash | 3.7% |
| VM (d.a.f.) | 36.6% |
| QI (db) | 95.6% |
| mineral matter (calc) | 4.6% |

-continued

| | |
|---|---|
| C d.m.m.f. | 82.7% |
| H d.m.m.f. | 5.0% |
| O d.m.m.f. | 9.2% |
| N d.m.m.f. | 1.8% |
| S a.r. | 1.55% |
| Cl a.r. | 0.35% |

The crushed coal was added to the liquid reactants, i.e., water and solvent, and was loaded into a cold autoclave and the lid then sealed. Carbon monoxide was then pumped into the autoclave to the required pressure before the treatment commenced. The contents were stirred thoroughly during heating, the heating to the reaction temperature was carried out over a period of 3 hours.

The reaction period noted in the following tables was the period spent at the reaction temperature from the time at which venting of the gases commenced, the autoclave was maintained at the reaction temperature for the stated period until the gas pressure had reached atmospheric. The heat was then turned off and the vessel cooled overnight to at or near room temperature. The gases vented from the autoclave were passed through a condensing system followed by a mist filter and cold trap, the distillate products consisted of a sticky extract-like material, water and some oil floating on the water. The water and oil were decanted, and separately cleaned and the remainder in the water was distilled off the extract-like material at 150° C and at 60 mm pressure.

Because the distinction between 'extract' and oil is arbitrary, and not comparable between the two types of run, the combined yield of extract plus oil is quoted as 'distillate' in the tables. The distillate analyses were carried out on the 'extract' only because this represented over 80% of the distillate.

In each of the following runs the solvent was toluene GPR grade and the results, operating conditions and analysis were as follows:

TABLE 1.

Gas extraction in the presence of carbon monoxide

| | | Product yields and properties | | | |
|---|---|---|---|---|---|
| Run | | 1 | 2 | 3 | 4 |
| Reaction temperature | ° C | 355 | 340 | 340 | 340 |
| Reaction time | hours | 2.0 | 1.8 | 2.0 | 1.0[1] |
| Reaction pressure | p.s.i. | 4000 | 6050 | 6000 | 5850 |
| Reactants | | | | | |
| Coal | g | 366.0 | 292.8 | 184.4[2] | 147.2[3] |
| Coal moisture | g | 34.0 | 27.2 | 0.0 | 0.0 |
| Added water | g | 130.0 | 900.0 | 898.1 | 897.7 |
| Toluene | g | 2001.4 | 1600.7 | 1599.5 | 1601.0 |
| Carbon monoxide | p.s.i. | 880 | 810 | 810 | 810 |
| Carbon monoxide (calc) | moles | 8.4 | 7.0 | 7.3 | 7.5 |
| Products | | | | | |
| Residue | g | 248.8 | 185.9 | 151.5 | 130.5 |
| Extract | g | 78.2 | 75.4 | 33.4 | & NA |
| Water | g | 134.2 | 894.3 | 864.6 | NA |
| Toluene | g | 1976.5 | 1568.7 | 1567.9 | NA |
| Gas | l | 200 | 174 | 173 | NA |
| Gas (calc) | g | 263 | 232 | 203 | NA |
| Residue ash (d.b.) | % | 6.5 | & NA | & NA | NA |
| Residue V.M.(d.a.f.) | % | 22.0 | NA | NA | NA |
| Residue Q.I.(d.b.) | % | 46.8 | & 51.6 | & 66.3 | & 67.3 |
| Extract softening point | ° C | 45 | 110 | 118 | & NA |
| M.W. | | 330 | 373 | 454 | NA |
| Calculated values | | | | | |
| Residue yield | % dry coal | 68.0 | 63.5 | 52.2 | 46.2 |
| Extract yield | % dry coal | 21.4 | 25.8 | 11.5 | & NA |
| Water make | % dry coal | −8.1 | −11.2 | −11.5 | NA |
| Gas make | % dry coal | 13.7 | 12.3 | −0.8 | NA |
| Loss | % dry coal | 18.0 | 20.6 | 22.7 | NA |

TABLE 1.-continued

| Gas extraction in the presence of carbon monoxide | | | | |
|---|---|---|---|---|
| | Product yields and properties | | | |
| Quinoline solubles | % dry coal | 57.6 | 56.5 | 54.9 | NA |

(1)Bursting disc ruptured
(2)Residue from 2
(3)Residue from 3

TABLE 2.

| Gas extraction in presence of carbon monoxide: | | | | | |
|---|---|---|---|---|---|
| | | | Analyses | | |
| Run | | | 1 | 2 | 3 |
| Residue | | | | | |
| $H_2O$ | a.r. | % | 0.8 | NA | NA |
| ash | a.r. | % | 6.3 | " | " |
| min matt | a.r. | % | 7.3 | " | " |
| C | d.m.m.f. | % | 89.2 | " | " |
| H | d.m.m.f. | % | 4.6 | " | " |
| O | d.m.m.f. | % | 2.9 | " | " |
| N | d.m.m.f. | % | 2.15 | " | " |
| S | a.r. | % | 1.25 | " | " |
| Cl | a.r. | % | 0.39 | " | " |
| Extract | | | | | |
| ash | a.r. | % | 0.09 | 0.11 | 0.62 |
| C | d.a.f. | % | 85.5 | 82.4 | 83.9 |
| H | d.a.f. | % | 7.9 | 7.0 | 6.8 |
| O | d.a.f. | % | 4.3 | 7.6 | 6.1 |
| N | d.a.f. | % | 1.45 | 1.60 | 1.75 |
| S | a.r. | % | 0.60 | 0.80 | 0.70 |
| Cl | a.r. | % | 0.35 | 0.60 | 0.80 |
| Gas | | | | | |
| $CO_2$ | | % | NA | 29.0 | 8.9 |
| $O_2$ | | % | " | 0.0 | 0.3 |
| $N_2$ | | % | " | 0.8 | 1.4 |
| $CH_4$ | | % | " | 0.6 | 0.1 |
| CO | | % | " | 59.3 | 77.7 |
| $H_2$ | | % | " | 10.9 | 10.1 |
| Total | | % | " | 100.6 | 98.5 |

I claim:

1. A process for the hydrogenative treatment of coal which comprises contacting the coal with carbon monoxide, water and a gaseous organic solvent at a reaction temperature within the range of 300° to 500° C., said solvent comprising one or more solvent components each of which, at the reaction temperature, is above its critical temperature and pressure, extracting the reaction products in the gaseous phase separating the gaseous phase from the residue, and thereafter recovering the reaction products from said gaseous phase.

2. A process as claimed in claim 1 characterized in that the carbon monoxide pressure is greater than 20 atmospheres gauge.

3. A process as claimed in claim 1 characterized in that the proportion of carbon monoxide per kilogram of coal is within the range of 200 grams to 800 grams.

4. A process as claimed in claim 3 characterized in that the proportion of water present is at least 1 mole of water per mole of carbon monoxide.

5. A process as claimed in claim 1 characterized in that the utilizable solvent component is a hydrocarbon.

6. A process as claimed in claim 1 characterized in that the utilizable solvent component is selected from aromatic hydrocarbons having a single benzene ring and not more than four carbon atoms in a substituent group thereof, cycloaliphatic hydrocarbons having at least five carbon atoms, aromatic hydrocarbons having at least two benzene rings and acyclic hydrocarbons having at least five and not more than 16 carbon atoms.

7. A process as claimed in claim 6 characterized in that the critical temperature of the utilizable solvent components is not more than 100° C. below the extraction temperature.

* * * * *